US010570754B2

(12) United States Patent
Tabata et al.

(10) Patent No.: US 10,570,754 B2
(45) Date of Patent: Feb. 25, 2020

(54) STEAM TURBINE ROTOR BLADE, METHOD FOR MANUFACTURING STEAM TURBINE ROTOR BLADE, AND STEAM TURBINE

(71) Applicant: MITSUBISHI HITACHI POWER SYSTEMS, LTD., Kanagawa (JP)

(72) Inventors: Soichiro Tabata, Kanagawa (JP); Yuki Enomoto, Kanagawa (JP); Naoto Tochitani, Kanagawa (JP); Shunji Imai, Kanagawa (JP); Takayuki Kurimura, Tokyo (JP); Naotoshi Okaya, Kanagawa (JP); Yuta Okimori, Kanagawa (JP); Haruhiko Asaka, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 284 days.

(21) Appl. No.: 15/507,042

(22) PCT Filed: Nov. 5, 2015

(86) PCT No.: PCT/JP2015/081223
§ 371 (c)(1),
(2) Date: Feb. 27, 2017

(87) PCT Pub. No.: WO2016/072473
PCT Pub. Date: May 12, 2016

(65) Prior Publication Data

US 2017/0268350 A1 Sep. 21, 2017

(30) Foreign Application Priority Data

Nov. 6, 2014 (JP) ..... 2014-226118

(51) Int. Cl.
*F01D 5/28* (2006.01)
*C23C 4/06* (2016.01)
(Continued)

(52) U.S. Cl.
CPC ..... *F01D 5/288* (2013.01); *C22C 19/07* (2013.01); *C23C 4/02* (2013.01); *C23C 4/06* (2013.01);
(Continued)

(58) Field of Classification Search
CPC ..... F01D 5/147; F01D 5/225; F01D 5/288; F05D 2300/17; F05D 2230/90;
(Continued)

(56) References Cited

U.S. PATENT DOCUMENTS 4,788,077 A * 11/1988 Kang ..... C23C 4/02 427/452
5,499,905 A * 3/1996 Schmitz ..... C23C 28/321 416/241 B
(Continued)

FOREIGN PATENT DOCUMENTS

CN 203906011 10/2014
JP 62-101802 5/1987
(Continued)

OTHER PUBLICATIONS

International Search Report dated Feb. 2, 2016 in International (PCT) Application No. PCT/JP2015/081223.
(Continued)

*Primary Examiner* — Charles G Freay
(74) *Attorney, Agent, or Firm* — Wenderoth, Lind & Ponack, L.L.P.

(57) ABSTRACT

A steam turbine rotor blade for forming a turbine rotor cascade of a steam turbine includes a rotor blade main body having a blade portion, a blade base portion and a first coupling portion, which has first facing surfaces, provided on opposite end sides of the blade portion, and a second coupling portion provided in an intermediate portion of the blade portion and having second facing surfaces. The steam
(Continued)

turbine rotor blade also includes a coating layer which is made of a Co-based alloy having a single composition on a surface of at least one of the first and second facing surfaces with a diffusion layer having a thickness of 10 μm or less provided between the coating layer and the surface.

10 Claims, 11 Drawing Sheets

(51) Int. Cl.

| | |
|---|---|
| ***C23C 4/02*** | (2006.01) |
| ***C23C 4/08*** | (2016.01) |
| ***F01D 5/22*** | (2006.01) |
| ***C23C 4/129*** | (2016.01) |
| ***C22C 19/07*** | (2006.01) |
| ***F01D 5/14*** | (2006.01) |

(52) U.S. Cl.
CPC ..... *C23C 4/08* (2013.01); *C23C 4/129* (2016.01); *F01D 5/147* (2013.01); *F01D 5/225* (2013.01); *F05D 2220/31* (2013.01); *F05D 2230/90* (2013.01); *F05D 2300/17* (2013.01)

(58) Field of Classification Search
CPC ..... F05D 2220/31; C23C 4/08; C23C 4/129; C23C 4/02; C23C 4/06; C22C 19/07
See application file for complete search history.

(56) References Cited

U.S. PATENT DOCUMENTS

| | | | | |
|---|---|---|---|---|
| 6,180,259 | B1 * | 1/2001 | Harada | C23C 4/02 427/453 |
| 9,365,932 | B2 * | 6/2016 | Anand | C23C 30/00 |
| 9,546,555 | B2 | 1/2017 | Chouhan et al. | |
| 2003/0012655 | A1 | 1/2003 | Sasaki et al. | |
| 2004/0124231 | A1 * | 7/2004 | Hasz | B23K 35/3046 228/245 |
| 2011/0117385 | A1 * | 5/2011 | Minor | B23K 1/0018 428/679 |
| 2014/0234110 | A1 | 8/2014 | Puram et al. | |
| 2015/0023793 | A1 * | 1/2015 | Bensalah | F01D 5/225 416/193 A |

FOREIGN PATENT DOCUMENTS

| | | |
|---|---|---|
| JP | 02-201001 | 8/1990 |
| JP | 4-005402 | 1/1992 |
| JP | 05-106403 | 4/1993 |
| JP | 10-008905 | 1/1998 |
| JP | 2895157 | 5/1999 |
| JP | 11-336502 | 12/1999 |
| JP | 2001-152803 | 6/2001 |
| JP | 2004-270023 | 9/2004 |
| JP | 2007-303440 | 11/2007 |
| JP | 4058906 | 3/2008 |
| JP | 2011-137424 | 7/2011 |
| JP | 2012-017486 | 1/2012 |
| JP | 2012-180764 | 9/2012 |
| JP | 2013-249532 | 12/2013 |
| JP | 2014-163371 | 9/2014 |
| JP | 2014-163381 | 9/2014 |
| JP | 2014-177709 | 9/2014 |

OTHER PUBLICATIONS

Chinese Office Action dated Sep. 26, 2017 in corresponding Chinese Patent Application No. 201580044571.8 with English translation.
Notice of Final Rejection dated Jun. 19, 2018 in corresponding Korean Application No. 10-2017-7003238, with English translation.
Chinese Office Action dated May 9, 2018 in corresponding Chinese Patent Application No. 201580044571.8 with Machine Translation.
International Preliminary Report on Patentability and Written Opinion of the International Searching Authority dated May 18, 2017 in International (PCT) Application No. PCT/JP2015/081223 with English translation.
Korean Office Action dated Feb. 21, 2018 in corresponding Korean Patent Application No. 10-2017-7003238 with Machine Translation.
Japanese Office Action dated Oct. 31, 2017 in corresponding Japanese Application No. 2016-557812, with Machine Translation.
Office Action dated Oct. 1, 2019 in Indian Patent Application No. 201717006946.

* cited by examiner

EXAMPLE
STELLITE (REGISTERED TRADEMARK) #6

COMPARATIVE EXAMPLE ($Cr_3C_2$-NiCr)

STEAM TURBINE ROTOR BLADE, METHOD FOR MANUFACTURING STEAM TURBINE ROTOR BLADE, AND STEAM TURBINE

TECHNICAL FIELD

The present disclosure relates to a steam turbine rotor blade, a method for manufacturing a steam turbine rotor blade, and a steam turbine.

BACKGROUND

For example, axial steam turbines used for power generation and the like include a plurality of turbine stator cascades and turbine rotor cascades. The turbine stator cascades each include a plurality of turbine stator blades, whereas the turbine rotor cascades each include a plurality of turbine rotor blades.

An integral shroud blade, disclosed as the turbine rotor blade in Japanese Patent Application Publication No. H4-5402, has an integral shroud at the distal end thereof. The blade is configured to deform by centrifugal force so as to be in a detorsion state when a turbine is operated, so that adjacent integral shrouds come into contact with each other.

In some cases, the turbine rotor blade of this type has an intermediate portion provided with an integral stub, as described in Japanese Patent Application Publication No. H4-5402, for achieving higher structural damping as a measure mainly focusing on an increase in stress due to an increase in a length of a steam turbine long blade. The integral shroud blade disclosed in Japanese Patent Application Publication No. H4-5402 is provided with the integral shroud on the distal end portion, and is further provided with integral stubs, as triangular protrusions, on both side surfaces at the intermediate portion of the blade. When the detorsion of the blade is achieved by the centrifugal force, the adjacent integral stubs come into contact with each other, whereby the higher structural damping is achieved.

Japanese Patent No. 4058906 and Japanese Patent Application Publication No. 2011-137424 each also disclose a turbine rotor blade with a distal end portion provided with an integral shroud, and with an intermediate portion provided with an integral stub.

In the rotor blade of a steam turbine disclosed in Japanese Patent No. 4058906, a distance between end surfaces of the integral shrouds (first coupling members) facing each other is set to be shorter than a distance between end surfaces of the integral stubs (second coupling members) facing each other. Thus, the integral shrouds come into contact with each other first, and then the integral stubs come into contact with each other as the rotation speed of the rotor increases. Thus, excessive stress is prevented from being generated at a coupling portion between the coupling members and the blade portion. The steam turbine having this configuration is regarded as having the rotor blade with improved reliability in terms of hardness and vibration, in an operation range from the start to a rated operation of the turbine.

In Japanese Patent Application Publication No. 2011-137424, an intermediate coupling member, provided to the rotor blade as a long blade, for improving vibration characteristics serves as a resistance in a path of steam flowing between the rotor blades, and thus degrades an aerodynamic performance. Thus, in the turbine rotor cascade disclosed in Japanese Patent Application Publication No. 2011-137424, the positional relationship between the rotor blades of the intermediate coupling members and the cross-sectional shape of the intermediate coupling member are optimized to reduce aerodynamic losses between the rotor blades.

The steam in the steam turbine is used for expansion work in each turbine stage, to have the energy reduced. Thus, in a stage on a more downstream side, the steam temperature is low and thus results in a steam path portion being a wet region. The turbine rotor blade rotating in the wet region might have a front edge portion, at the distal end of the blade involving high circumferential speed, eroded due to corrosion of droplets in the steam. In view of this, Japanese Patent Application Publication No. 2004-270023 discloses a method for treating devices subject to erosion by liquids and an anti-erosion coating alloy.

The method for treating devices subject to erosion by liquids disclosed in Japanese Patent Application Publication No. 2004-270023 includes applying a cobalt-based alloy, having a predetermined composition, by laser plating on the blade of the steam turbine as the device subject to erosion by liquids.

Japanese Patent Application Publication No. 2014-163371 discloses a technique of forming a coating on a coupling member (cover and tie boss) contact surface of a turbine rotor blade made of a titanium alloy by high-velocity flame spraying (HVOF spraying) in which chromium carbide (CrC) is sprayed with NiCr used as a binder. Thus, the high-velocity flame spraying in which a mixture is sprayed is disclosed in Japanese Patent Application Publication No. 2014-163371.

Technical Problem

A recent trend toward a larger output of a steam turbine has led to an operation condition of the turbine that is extremely harsh on a turbine rotor blade, in particular, the turbine rotor blade on a final stage. The present inventors have found that there are several matters, other than the erosion of the front edge of the blade (erosion due to collision of droplets), related to each turbine rotor blade and are preferably improved for achieving a higher durability of the steam turbine under the harsh condition.

Specifically, the present inventors have found that it is preferable to prevent damage due to fretting in a contact portion, such as a shroud and an integral stub of the turbine rotor blade, between the turbine rotor blades. More specifically, fretting wear and fatigue might occur due to repeated minute reciprocating sliding and repeated load acting on the contact surface.

The inventors have found that even a turbine rotor blade made of stainless steel, which has a smaller frictional coefficient than a titanium alloy and thus has been considered to have almost no risk of being damaged by fretting, is preferably prevented from being damaged by fretting due to an increase in peak stress at the contact portion as a result of increasing the output.

SUMMARY

In view of the above, an object of at least one embodiment of the present invention is to provide a steam turbine rotor blade, a method for manufacturing a steam turbine rotor blade, and a steam turbine in which the damage due to the fretting wear and fatigue is prevented in a contact portion between adjacent turbine rotor blades.

Solution to Problem (1) A steam turbine rotor blade for forming a turbine rotor cascade of a steam turbine according to at least one embodiment of the present invention includes:

a rotor blade main body including: a blade portion; a blade base portion provided on one end side of the blade portion; a first coupling portion which is provided on another end side of the blade portion and has first facing surfaces; and a second coupling portion which is provided in an intermediate portion of the blade portion and has second facing surfaces, the first facing surfaces each configured to face one of first facing surfaces of an adjacent rotor blade main body in the turbine rotor cascade, and the second facing surfaces each configured to face one of second facing surfaces of the adjacent rotor blade main body in the turbine rotor cascade; and a coating layer which is made of a Co-based alloy having a single composition and is formed by high-velocity flame spraying on a surface of at least one of the first facing surface and the second facing surface with a diffusion layer having a thickness of 10 μm or less provided between the coating layer and the surface.

The coating layer made of the Co-based alloy having a single composition is formed on at least one of the first facing surface and the second facing surface. Adjacent ones of the turbine rotor blades have the coating layers, made of the Co-based alloy having a single composition, in contact with each other. The coating layers made of the Co-based alloy having a single composition have a high fretting resistance performance. In the configuration (1) described above, at least one of the first coupling portion and the second coupling portion provided with the coating layer is free of damage due to fretting wear and fatigue.

The coating layer is formed on the first facing surface and/or the second facing surface by high-velocity flame spraying, and the thickness of the diffusion layer is 10 μm or less. Thus, a crack may be formed on the coating layer due to fretting, but will not reach the coated layer (base material). Thus, the damage due to fretting might occur but does not require replacement of the blade as a whole, and requires simple repairing with Co-based alloy coating provided again through the high-velocity flame spraying.

(2) In some embodiments, in the configuration (1) described above, the coating layer is formed at least on the surface of the second facing surface. The second coupling portion is provided to achieve a higher structural damping and the peak stress acting on the second facing surface of the second coupling portion has not been so large. However, the recent trend toward the larger output of the steam turbine and the longer steam turbine rotor blades has led to an increase in the peak stress acting on the second facing surface of the second coupling portion. Thus, it has been found that a risk of the second coupling portion being damaged due to fretting has increased.

In view of this, in the configuration (2) described above, the coating layer is formed on the second facing surface of the second coupling portion. Thus, the second coupling portion can be prevented from being damaged due to fretting.

(3) In some embodiments, in the configuration (1) or (2) described above, the first coupling portion includes first inclined surfaces which obliquely continue to side edges of the first facing surfaces so that a distance between adjacent first coupling portions in the turbine rotor cascade increases, and the second coupling portion includes second inclined surfaces which obliquely continue to side edges of the second facing surfaces so that a distance between adjacent second coupling portions in the turbine rotor cascade increases.

In the configuration (3) described above, the first inclined surfaces that continue to both side edges of the first facing surface of the first coupling portion are provided. Thus, uneven contact between the first facing surfaces is prevented, whereby peak stress acting on the first facing surface can be reduced. All things considered, the first coupling portion can be more effectively prevented from being damaged due to fretting.

When the first inclined surfaces are provided, the area of the first facing surface is substantially reduced, and thus average surface pressure on the first facing surface rises. Still, with the coating layer formed on the surface of the first facing surface, fretting wear and fatigue due to the rise in the average surface pressure can be prevented.

In the configuration (3) described above, the second inclined surfaces that continue to side edges of the second facing surface of the second coupling portion are provided. Thus, uneven contact between the second facing surfaces is prevented, whereby peak stress acting on the second facing surface can be reduced. Thus, the second coupling portion can be more effectively prevented from being damaged due to fretting.

When the second inclined surface is provided, the area of the second facing surface is substantially reduced, and thus average surface pressure on the second facing surface rises. Still, with the coating layer formed on the surface of the second facing surface, fretting wear and fatigue due to the rise in the average surface pressure can be prevented.

(4) In some embodiments, in any one of the configurations (1) to (3), the first coupling portion includes first curved surfaces which continue to distal end edges of the first facing surfaces so that a distance between adjacent first coupling portions in the turbine rotor cascade increases, and the second coupling portion includes second curved surfaces which continue to distal end edges of the second facing surfaces so that a distance between adjacent second coupling portions in the turbine rotor cascade increases.

In the configuration (4) described above, the first curved surfaces that continue to the distal end edges of the first facing surface of the first coupling portion is provided. Thus, uneven contact between the first facing surfaces is prevented, whereby peak stress acting on the first facing surface can be reduced. Thus, the first coupling portion can be more effectively prevented from being damaged due to fretting.

When the first curved surfaces are provided, the area of the first facing surface is substantially reduced, and thus average surface pressure on the first facing surface rises. Still, with the coating layer formed on the surface of the first facing surface, fretting wear and fatigue due to the rise in the average surface pressure can be prevented.

In the configuration (4) described above, the second curved surfaces that continue to the distal end edges of the second facing surface of the second coupling portion are provided. Thus, uneven contact between the second facing surfaces is prevented, whereby peak stress acting on the second facing surface can be reduced. All things considered, the second coupling portion can be more effectively prevented from being damaged due to fretting.

When the second curved surfaces are provided, the area of the second facing surface is substantially reduced, and thus average surface pressure on the second facing surface rises. Still, with the coating layer formed on the surface of the second facing surface, fretting wear and fatigue due to the rise in the average surface pressure can be prevented.

(5) In some embodiments, in any one of the configurations (1) to (3), the first coupling portion includes third inclined surfaces which continue to distal end edges of the first facing surfaces so that a distance between adjacent first coupling portions in the turbine rotor cascade increases, and the second coupling portion includes fourth inclined surfaces which continue to distal end edges of the second facing surfaces so that a distance between adjacent second coupling portions in the turbine rotor cascade increases.

In the configuration (5) described above, the third inclined surface and the fourth inclined surface are provided so that the first coupling portion and the second coupling portion can be more effectively prevented from being damaged due to fretting, as in the configuration (4) described above.

The local stress acting on the distal end edge is larger than that on the side edge in the first facing surface and the second facing surface. In view of this, in the configuration (4) described above, the inclined surface continues to the side edge, whereas the curved surface continues to the distal end edge. With the curved surface thus provided in such a manner as to continue to the distal end edge involving higher local stress, the prevention of the uneven contact is guaranteed, whereby the fretting wear and the fretting fatigue can be more effectively prevented.

(6) In some embodiments, in the configuration (2) described above, the second coupling portion includes:

second inclined surfaces which obliquely continue to side edges of the second facing surfaces so that a distance between adjacent second coupling portions in the turbine rotor cascade increases; and second curved surfaces which continue to distal end edges of the second facing surfaces so that the distance between the adjacent second coupling portions in the turbine rotor cascade increases.

In the configuration (6) described above, the second inclined surfaces that continue to the side edges of the second facing surface are provided, and the second curved surfaces that continue to the distal end edges of the second facing surface are provided. Thus, the second coupling portion can be more effectively prevented from being damaged due to fretting.

(7) A steam turbine rotor blade for forming a turbine rotor cascade of a steam turbine according to at least one embodiment includes:

a rotor blade main body including: a blade portion; a blade base portion provided on one end side of the blade portion; a first coupling portion which is provided on another end side of the blade portion and has first facing surfaces; and a second coupling portion which is provided in an intermediate portion of the blade portion and has second facing surfaces, the first facing surfaces each configured to face one of first facing surfaces of an adjacent rotor blade main body in the turbine rotor cascade, and the second facing surfaces each configured to face one of second facing surfaces of the adjacent rotor blade main body in the turbine rotor cascade; and a coating layer which is made of a fretting wear resistant material and is formed on a surface of each of the second facing surfaces, in which in a cross section of the rotor blade main body at a position where the second coupling portion is provided, an acute angle is formed between the second facing surface and a line connecting a front edge and a rear edge of the blade portion, and a perpendicular line to the second facing surface crosses the blade portion, and the second coupling portion includes second inclined surfaces which obliquely continue to side edges of the second facing surface so that a distance between adjacent second coupling portions in the turbine rotor cascade increases.

In a case where the second coupling portion is provided to the blade portion in such a manner that in a cross-section of the rotor blade main body at a position where the second coupling portion is provided, an acute angle is formed between the second facing surface and a line connecting a front edge and a rear edge of the blade portion, and a perpendicular line to the second facing surface crosses the blade portion, when the surface continuing to the side edge of the second facing surface is processed, a manual operation is required because a machine tool would interfere with the blade portion at the base end of the second coupling portion. However, by forming the surface continuing to the side edge as a simple inclined surface, the manual operation can be simple and stable.

(8) In some embodiments, in any one of the configurations (1) to (7), the rotor blade main body is made of precipitation hardening stainless steel.

When the rotor blade main body is made of the precipitation hardening stainless steel, the formed rotor blade main body is subjected to heat treatment, for example, solution treatment and age hardening treatment executed in this order, so that the hardness of the stainless steel is adjusted to be an appropriate value. When the rotor blade main body is heated after the heat treatment, the heat treatment needs to be performed again to adjust the hardness. When any processing is to be executed on the rotor blade main body after the heat treatment, the temperature of the rotor blade main body is required to be managed so as not to exceed the heat treatment temperature.

In this regard, according to the configuration (8) described above, the high-velocity flame spraying involves almost no heating of the rotor blade main body. Thus, the high-velocity flame spraying does not change the hardness of the rotor blade main body. Thus, the coating layer can be easily formed without requiring any special temperature management for the rotor blade main body.

Precipitation hardening stainless steel has a lower frictional coefficient than a titanium alloy. Thus, the rotor blade made of precipitation hardening stainless steel has been almost completely free of fretting wear and fatigue. However, the recent trend toward the larger output of the steam turbine and the longer rotor blades has led to an increase in the peak stress acting on the first facing surface and the second facing surface. Thus, it has been found that a risk of the first coupling portion and the second coupling portion being damaged due to fretting has increased.

In view of this, in the configuration (8) described above, the coating layer is provided on the surface of at least one of the first facing surface and the second facing surface in the rotor blade main body made of precipitation hardening stainless steel, whereby the damage due to fretting can be prevented.

In the steam turbine, the final-stage rotor blade is designed to be long to achieve a large annular area for facilitating an attempt to reduce exhaust air loss. In this context, the turbine rotor blade according to the configurations (1) to (8) can be designed to be long without involving a damage on the contact portion between the adjacent turbine rotor blades, and thus is suitable for the final-stage rotor blade in the steam turbine.

(9) A steam turbine provided according to at least one embodiment of the present invention includes a steam turbine rotor blade having any one of the configurations (1) to (8) described above.

(10) A method of manufacturing a steam turbine rotor blade for forming a turbine rotor cascade of a steam turbine according to at least one embodiment of the present invention includes:

a step of providing a rotor blade main body including: a blade portion; a blade base portion provided on one end side of the blade portion; a first coupling portion which is provided on another end side of the blade portion and has first facing surfaces; and a second coupling portion which is provided in an intermediate portion of the blade portion and has second facing surfaces, the first facing surfaces each configured to face one of first facing surfaces of an adjacent rotor blade main body in the turbine rotor cascade, and the second facing surfaces each configured to face one of second facing surfaces of the adjacent rotor blade main body in the turbine rotor cascade; and a high-velocity flame spraying step of performing high-velocity flame spraying to form, on a surface of at least one of the first facing surface and the second facing surface, a coating layer which is made of a Co-based alloy having a single composition, in which in the high-velocity flame spraying step, powder of the Co-based alloy is sprayed onto a facing surface to be coated, which is one of the first facing surface and the second facing surface, at an angle equal to or larger than 0° and equal to or smaller than 60° relative to a normal line of the facing surface.

When the spraying direction is inclined relative to the normal line to the facing surface by an angle in the range between 0° inclusive and 60° inclusive, the coating layer can have a low porosity and thus can have a high fretting resistance performance.

Advantageous Effects

According to at least one embodiment of the present invention, a steam turbine rotor blade, a method for manufacturing a steam turbine rotor blade, and a steam turbine in which the damage due to the fretting is prevented in a contact portion between adjacent turbine rotor blades are provided.

DETAILED DESCRIPTION

Figure 1:
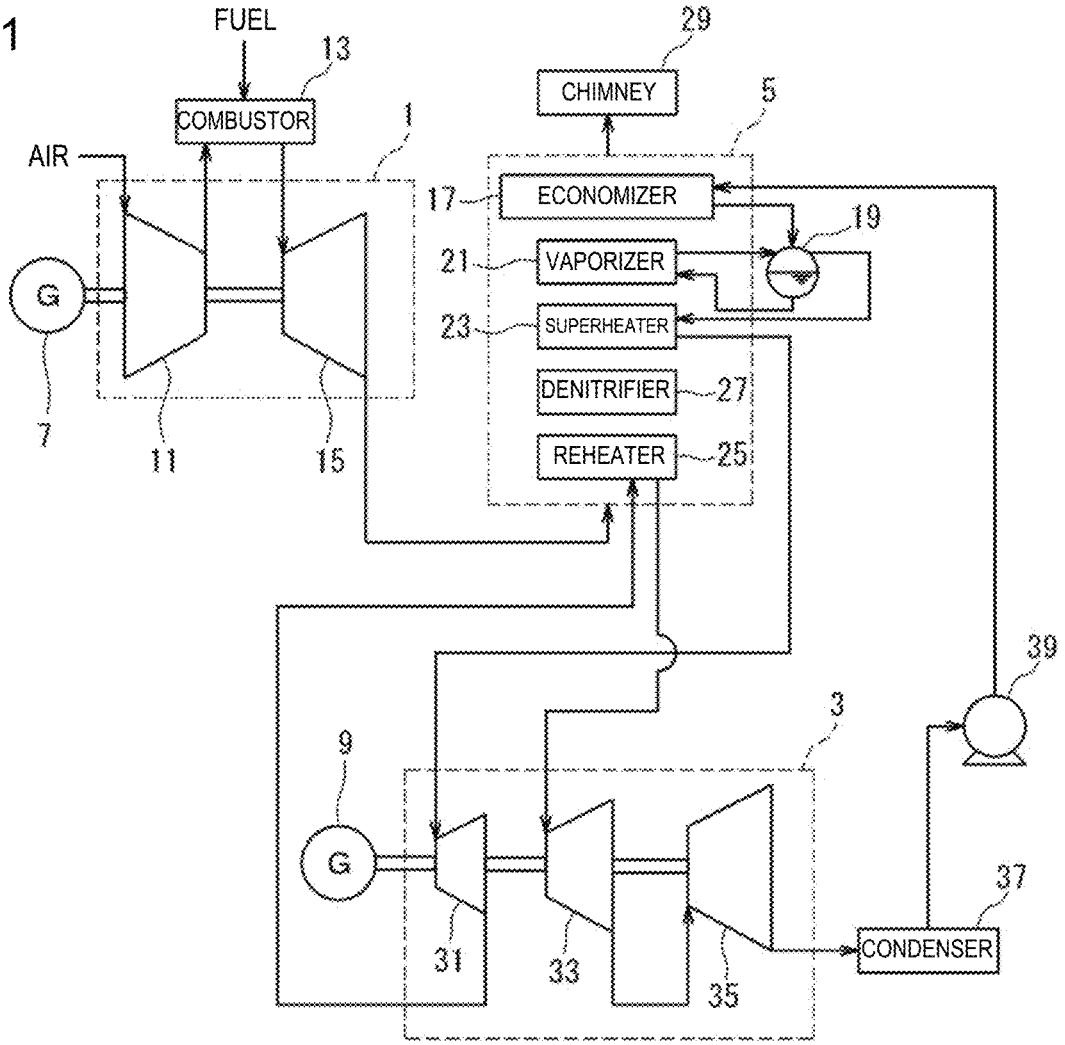
FIG. 1 is a block diagram schematically illustrating a configuration of a power generation system according to one embodiment of the present invention.

The following describes some embodiments of the present invention with reference to the accompanying drawings. It should be noted that the sizes, materials, shapes, relative arrangement, and the like of the components described as embodiments or illustrated in the drawings are given by way of example and not intended to limit the scope of the present invention.

As used herein, for example, expressions representing relative or absolute arrangement, including "in a direction", "along a direction", "in parallel with", "orthogonal to", "center", "concentric", and "coaxial", not only represent exactly what they mean but also include states relatively displaced with a tolerance or by an angle or distance that is small enough to provide the same level of functionality.

As used herein, for example, expressions meaning that things are in identical states, including "the same", "identical", and "homogenous", not only represent exactly identical states but also include states with a tolerance or a difference that is small enough to provide the same level of functionality.

As used herein, for example, expressions representing shapes, such as quadrangles and cylinders, not only represent geometrically exact quadrangles, cylinders, or the like but also include shapes having some irregularities as long as the same level of functionality can be achieved.

Furthermore, the expressions of "including", "comprising", "provided with", and "having" one component as used herein do not exclude other components.

FIG. 1 is a block diagram schematically illustrating a configuration of a power generation system according to one embodiment of the present invention. The power generation system is a combined power generation system including a gas turbine 1, a steam turbine 3, an exhaust heat recovery boiler 5, and generators 7 and 9.

In some embodiments, the power generation system is a conventional power generation system including: a boiler, provided instead of the exhaust heat recovery boiler 5, in which fuel is combusted to generate steam; and the steam turbine 3. In some embodiments, the power generation system is for household use, and in some embodiments, the power generation system is for commercial use.

The gas turbine 1 includes a compressor 11, a combustor 13, and a turbine 15. The compressor 11 compresses air by using a part of an output from the turbine 15. The compressed air is supplied to the combustor 13. In the combustor 13, the compressed air and fuel are supplied, and the fuel is combusted. Combustion gas generated by the fuel combustion is supplied to the turbine 15, to be used by the turbine 15 for generating torque as an output.

The turbine 15 is connected to the generator 7 that uses a part of the output from the turbine 15 to generate power.

The combustion gas after the work in the turbine 15 (hereinafter, also referred to as exhaust gas) is supplied to the exhaust heat recovery boiler 5. The exhaust heat recovery boiler 5 uses heat (exhaust heat) of the combustion gas to generate steam.

For example, the exhaust heat recovery boiler 5 includes an economizer 17, a header 19, a vaporizer 21, a superheater 23, a reheater 25, and a denitrifier 27. Water is heated by the economizer 17, the vaporizer 21, and the superheater 23, whereby superheated steam is obtained. The superheated steam is supplied to the steam turbine 3. The steam supplied to the steam turbine 3 temporarily returns to the exhaust heat recovery boiler 5, and then is supplied to the reheater 25. The reheater 25 heats the steam, and the heated steam is supplied to the steam turbine 3.

The denitrifier 27 has a function of removing NOx in the exhaust gas. For example, the exhaust gas discharged from the exhaust heat recovery boiler 5 is discharged outside through a chimney 29.

The steam turbine 3 is connected to the generator 9. The steam turbine 3 uses the steam to generate torque. The generator 9 uses the torque to generate power. For example, the steam turbine 3 includes a high-pressure turbine 31, a mid-pressure turbine 33, and a low-pressure turbine 35 that each use the steam to generate torque.

A condenser 37 is connected to the steam turbine 3. The steam discharged from the low-pressure turbine 35 of the steam turbine 3 is condensed by the condenser 37 to be water. The condenser 37 is connected to the exhaust heat recovery boiler 5 via a condensing pump 39. The condensing pump 39 supplies the water, obtained by the condenser 37, to the exhaust heat recovery boiler 5.

Figure 2:
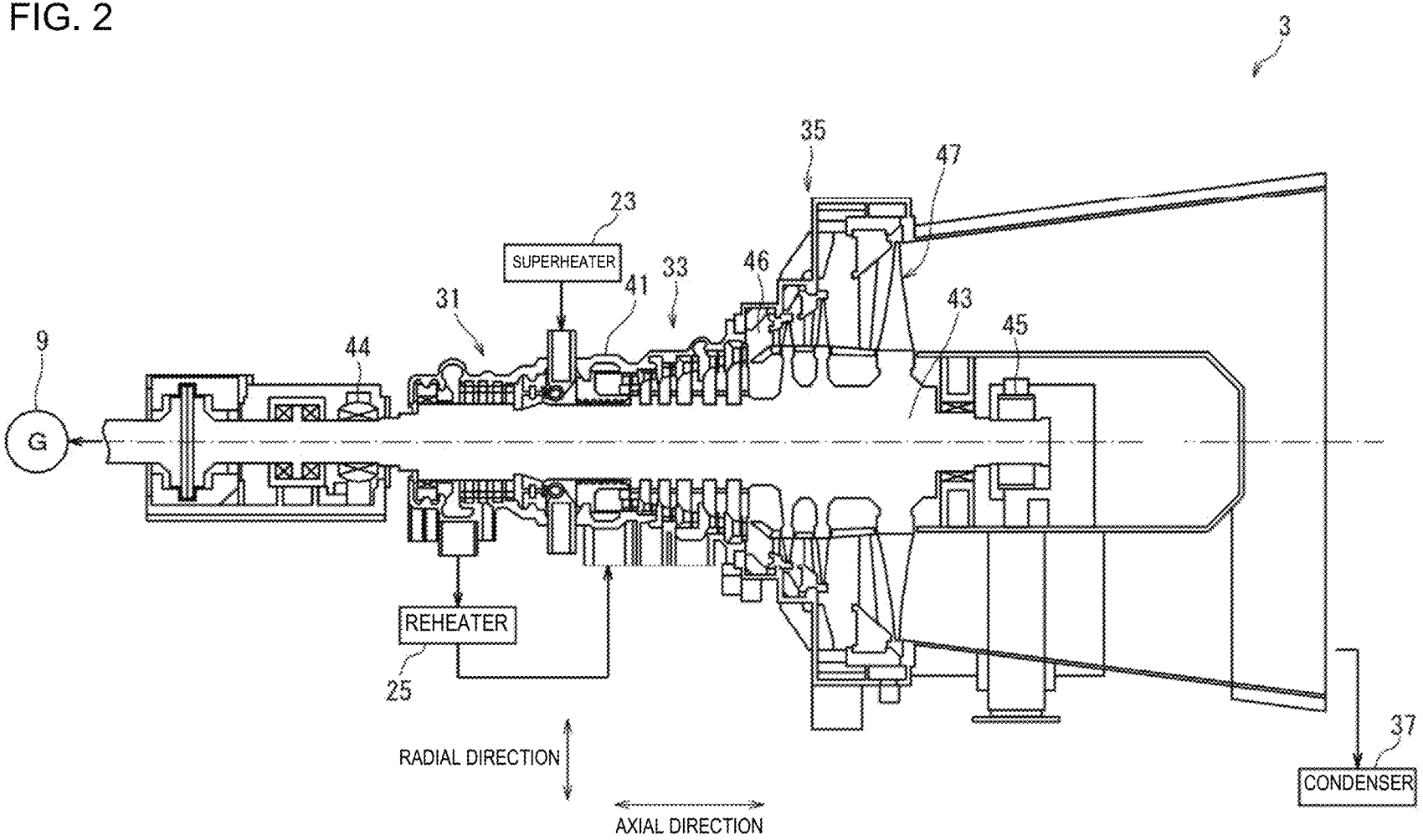
FIG. 2 is a vertical cross-sectional view illustrating a schematic configuration of a steam turbine.

FIG. 2 is a vertical cross-sectional view illustrating a schematic configuration of the steam turbine 3.

The steam turbine 3 illustrated in FIG. 2 is a single-chamber steam turbine in which the high-pressure turbine 31, the mid-pressure turbine 33, and the low-pressure turbine 35 are integrally formed. In some embodiments, a combined-chamber steam turbine may be employed in which a high-pressure turbine, a mid-pressure turbine, and a low-pressure turbine are separately formed. The combined-chamber steam turbine may have a tandem structure or a cross structure.

The steam turbine 3 illustrated in FIG. 2 includes: a housing 41 defining a chamber; a rotor 43; turbine stator cascades fixed to the housing 41; and a plurality of turbine rotor cascades fixed to the rotor 43. The rotor 43 is rotatably supported by radial bearings 44 and 45, and at least partially extends in the housing 41. The generator 9 is connected to one end side of the rotor 43.

A tubular inner flow path 46 is formed between the housing 41 and the rotor 43. The turbine stator cascades and the turbine rotor cascades are disposed in the inner flow path 46. The turbine stator cascades and the turbine rotor cascades include one provided to the high-pressure turbine 31, one provided to the mid-pressure turbine 33, and one provided to the low-pressure turbine 35. Each turbine stator cascade includes a plurality of stator blades that are arranged in a circumferential direction of the rotor 43, and are each fixed to the housing 41. Each turbine rotor cascade includes a plurality of rotor blades that are arranged in the circumferential direction of the rotor 43, and are each fixed to the rotor 43. In each turbine stator cascade, the steam flow is accelerated, and in each turbine rotor cascade, steam energy is converted into rotational energy of the rotor 43.

A turbine rotor cascade (hereinafter, referred to as a final-stage turbine rotor cascade) 47 that is positioned on the most downstream side in a steam flow direction and corresponds to the low-pressure turbine 35 is in charge of the largest proportion of the output from the steam turbine 3. Thus, the final-stage turbine rotor cascade 47 is designed to have a largest-possible size, to achieve a higher efficiency of the steam turbine 3 with the exhaust air loss reduced.

Figure 3:
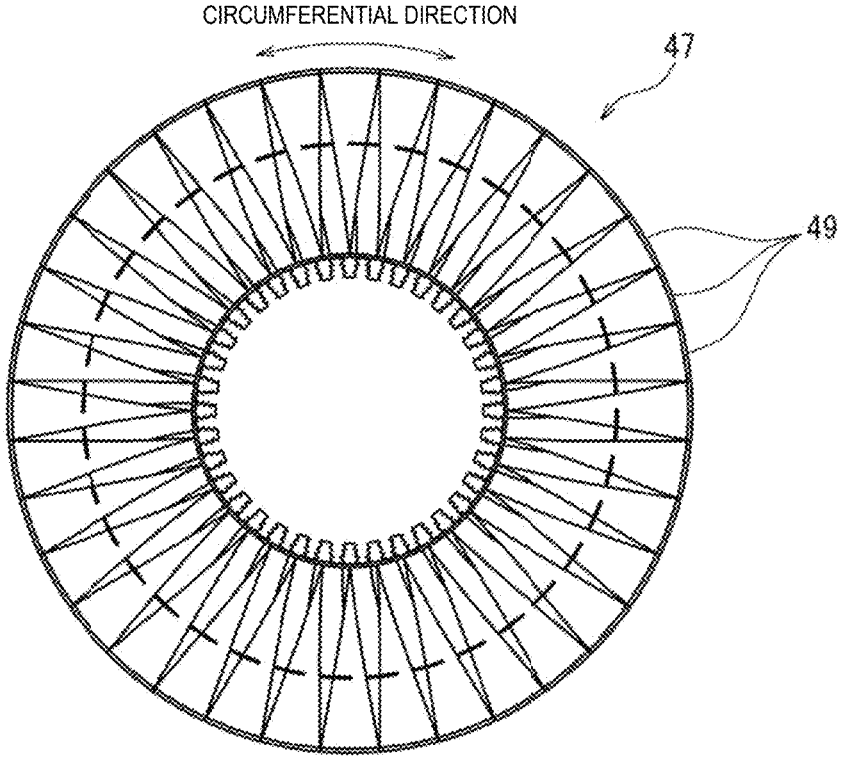
FIG. 3 is a plan view schematically illustrating a final-stage turbine rotor cascade.
Figure 4:
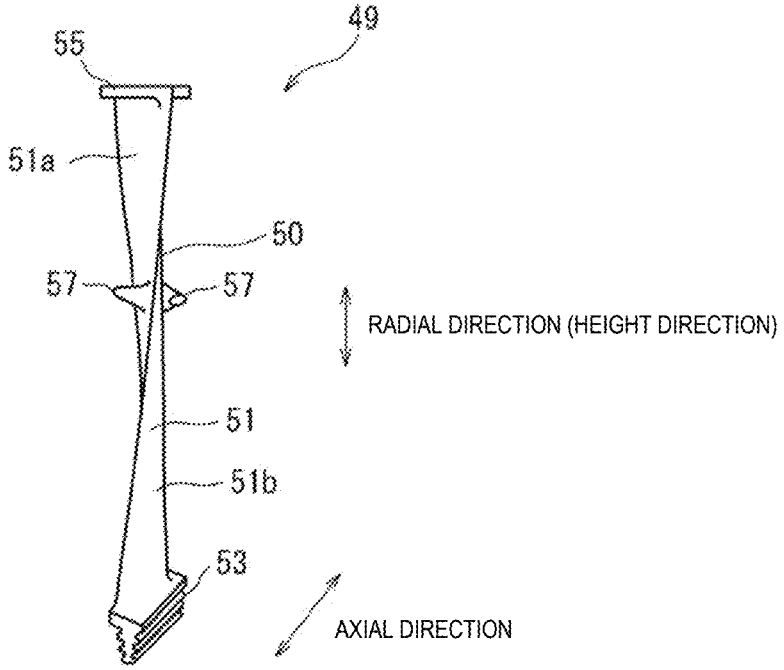
FIG. 4 is a perspective view schematically illustrating one rotor in a final-stage turbine rotor cascade.

FIG. 3 is a plan view schematically illustrating the final-stage turbine rotor cascade 47. FIG. 4 is a perspective view schematically illustrating one rotor blade (hereinafter, referred to as a final-stage rotor blade) 49 in the final-stage turbine rotor cascade 47.

The rotor blade 49 includes a rotor blade main body 50 including a blade portion 51, a blade base portion 53, a first coupling portion 55, and a second coupling portion 57.

The blade portion 51 includes a high-pressure surface (front face) 51*a* and a low-pressure surface (back face) 51*b* that face opposite directions. A flow path for the steam is formed between the high-pressure surface 51*a* and the low-pressure surface 51*b* of the blade portions 51 adjacent to each other. The blade portion 51 receives energy from the steam flowing in the flow path. The high-pressure surface 51*a* and the low-pressure surface 51*b* of the blade portion 51 each have a predetermined width and extend in a radial direction of the rotor 43. The blade portion 51 has a predetermined shape in a cross-section taken along a ling orthogonal to the radial direction. Circumferential speed of the blade portion 51 is different between the inner and outer sides in the radial direction. Thus, the high-pressure surface 51*a* and the low-pressure surface 51*b* of the blade portion 51 each has a shape gradually twisted from the inner side toward the outer side in the radial direction of the rotor 43.

The blade base portion 53 is integrally provided to one end side (base end side) of the blade portion 51 in the radial direction of the rotor 43. The rotor 43 has an engagement portion to be capable of engaging with the blade base portion 53. Thus, the final-stage rotor blade 49 is fixed to the rotor 43 via the blade base portion 53.

In some embodiments, the blade base portion 53 has a Christmas tree shape in a cross-section taken along a line orthogonal to an axial direction of the rotor 43. In this case, a groove extending in the axial direction as the engagement portion is formed in the rotor 43, and the blade base portion 53 is inserted in the groove of the rotor 43 in the axial direction.

Figure 5:
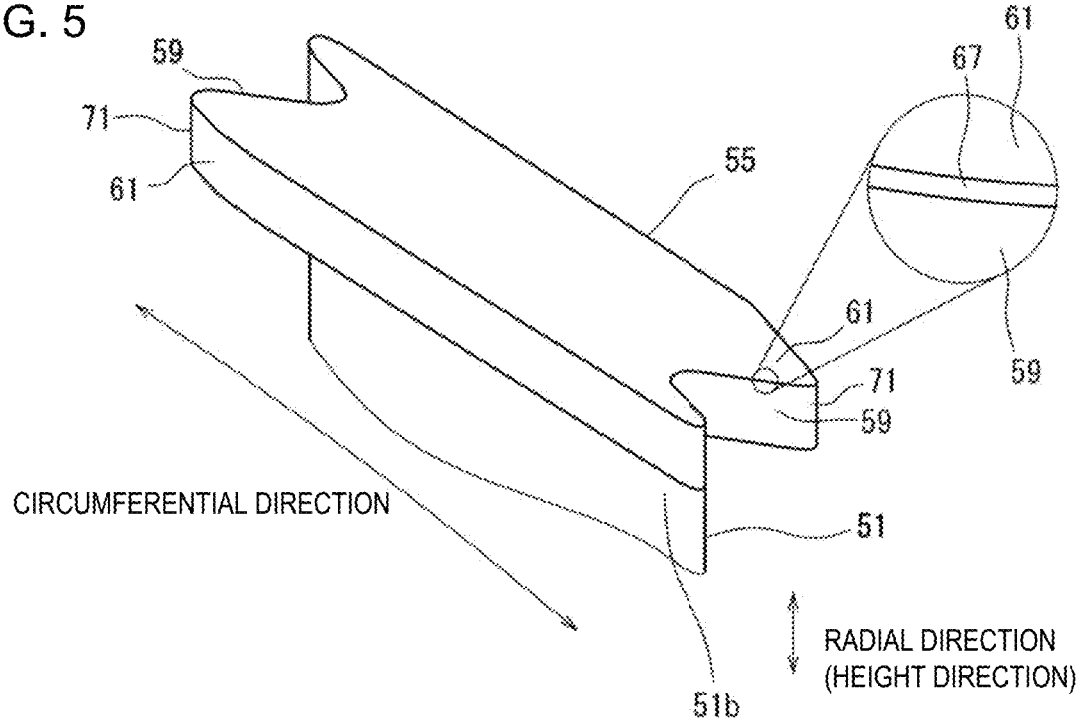
FIG. 5 is a diagram schematically illustrating a first coupling portion and a part of the blade portion.
Figure 6:
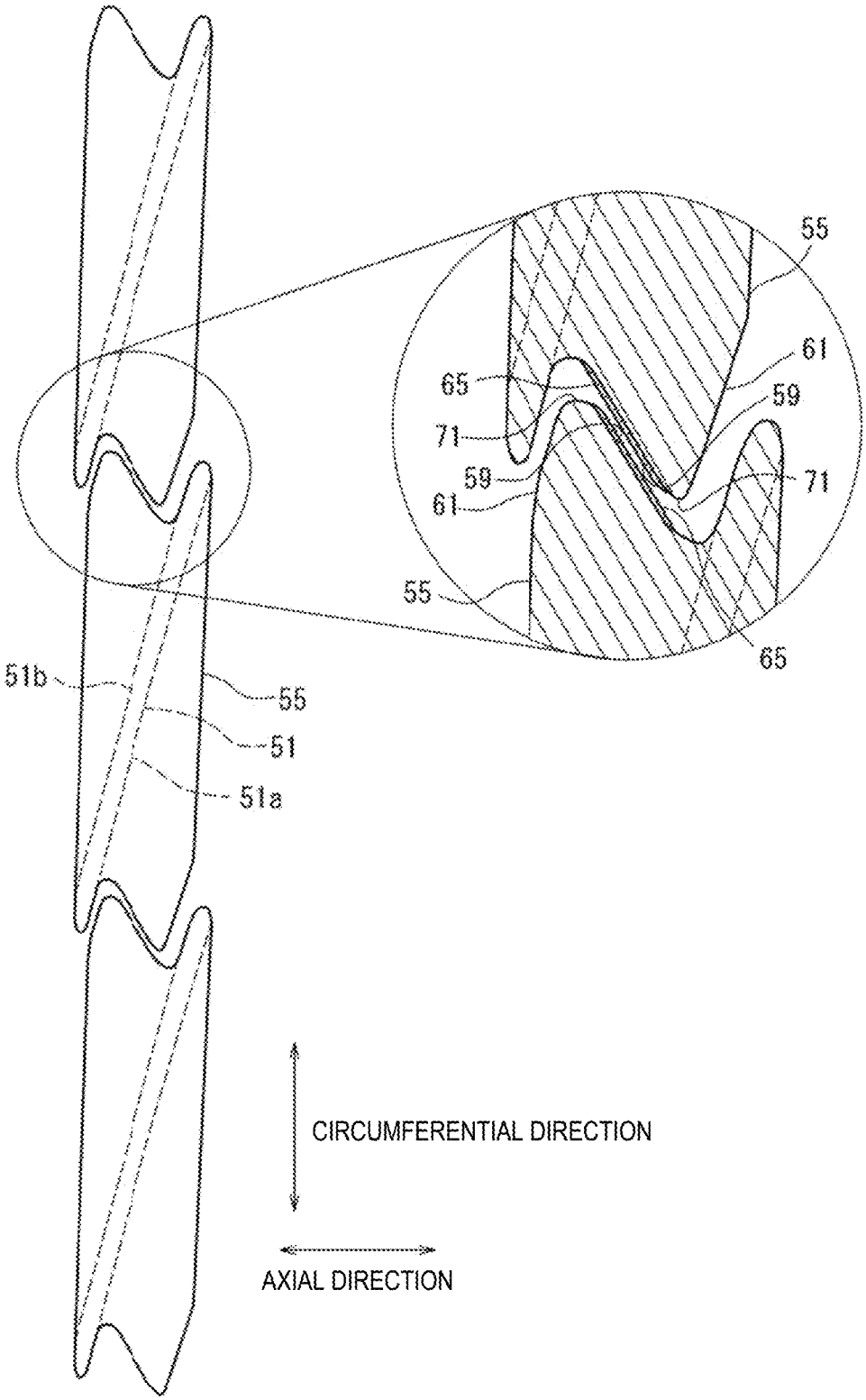
FIG. 6 is a development diagram schematically illustrating a plurality of first coupling portions, with an enlarged view in a circle schematically illustrating a cross-section taken along a line orthogonal to the radial direction.

The first coupling portion 55 is integrally provided to the other end side (distal end side) of the blade portion 51 in the radial direction of the rotor 43. FIG. 5 schematically illustrates the first coupling portion 55 and a part of the blade portion 51. FIG. 6 is a development diagram schematically illustrating the plurality of first coupling portions 55.

The first coupling portion 55 is also referred to as an integral shroud, and is provided to achieve a small vibration amplitude and a small mode number of the final-stage turbine rotor cascade 47 having a large size. Specifically, the small vibration amplitude and the small mode number of the final-stage turbine rotor cascade 47 are achieved with the adjacent final-stage rotor blades 49 coupled to each other to be integrated via the first coupling portion 55 on the outer side in the radial direction of the rotor 43.

More specifically, the first coupling portion 55 has first facing surfaces 59 on both sides in the circumferential direction of the rotor 43. The first facing surfaces 59 of the adjacent final-stage rotor blades 49 face each other. The first facing surfaces 59 facing each other are formed in such a manner as to be in parallel with each other when detorsion of the blade portions 51 is achieved by centrifugal force, when the steam turbine 3 is in operation.

For example, the first coupling portion 55 has protrusions 61, having a triangular pole shape, on both sides in the circumferential direction of the rotor 43, and the protrusion 61 has one side surface forming the first facing surface 59.

Figure 7:
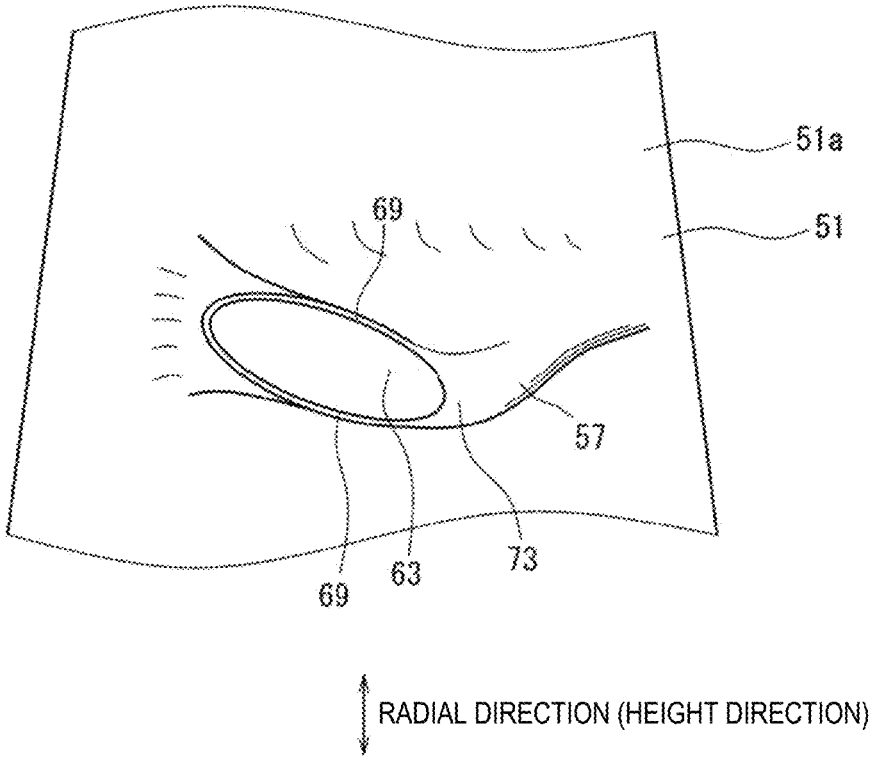
FIG. 7 is a diagram schematically illustrating a second coupling portion and a part of the blade portion.
Figure 8:
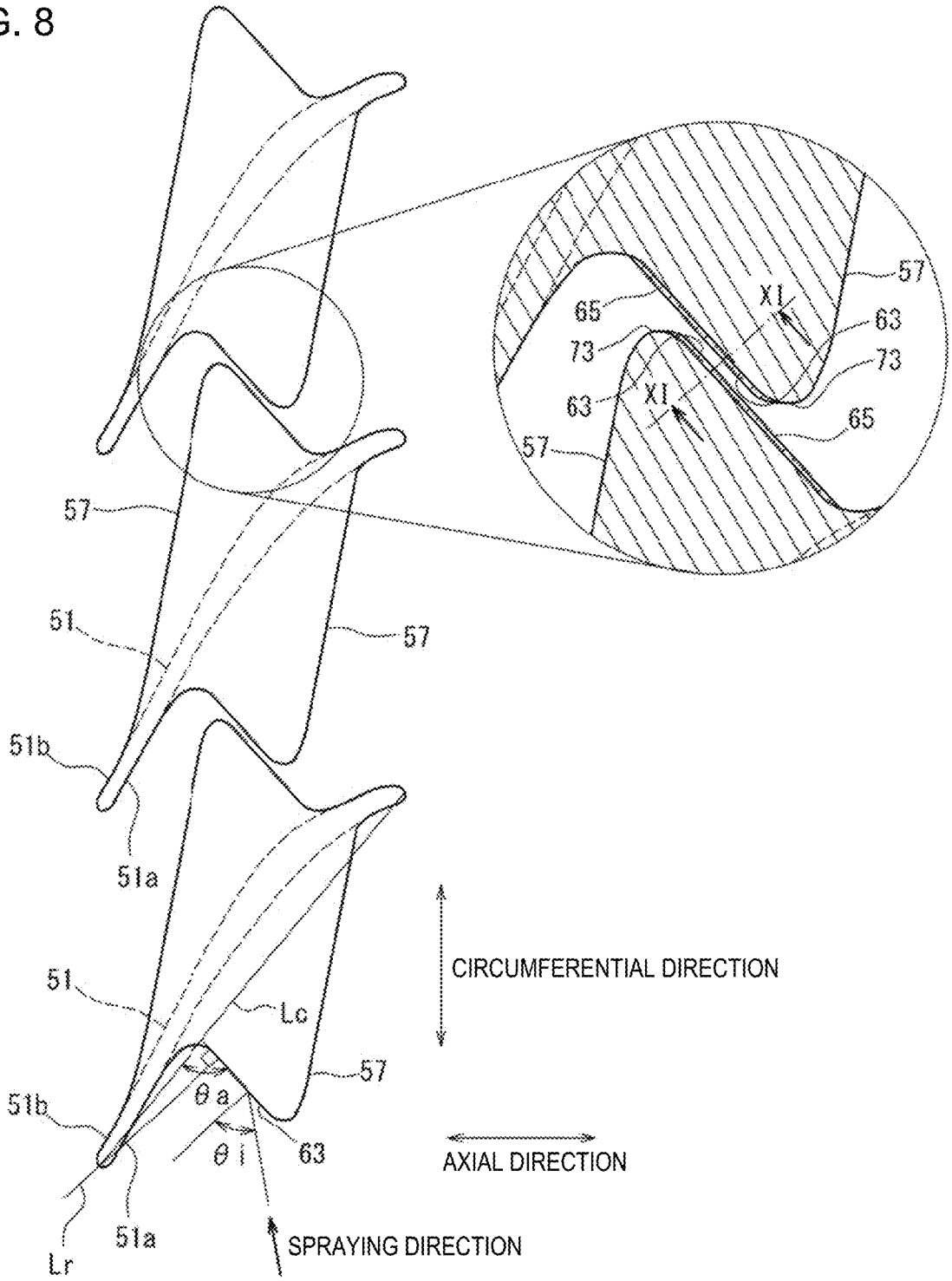
FIG. 8 is a development diagram schematically illustrating a plurality of second coupling portions, with an enlarged view in a circle schematically illustrating a cross-section taken along the line orthogonal to the radial direction.

The second coupling portion 57 is integrally provided to each of the high-pressure surface 51*a* and the low-pressure surface 51*b* of the blade portion 51, at an intermediate portion in the radial direction of the rotor 43. FIG. 7 schematically illustrates the second coupling portion 57 and a part of the blade portion 51. FIG. 8 is a development diagram schematically illustrating the plurality of second coupling portions 57.

The second coupling portion 57 is also referred to as an integral stub, and is provided mainly for achieving higher structural damping of the final-stage turbine rotor cascade 47 with a large size. Specifically, the higher structural damping of the final-stage turbine rotor cascade 47 is achieved with the adjacent final-stage rotor blades 49 coupled to each other to be integrated at intermediate portions in the radial direction of the rotor 43 via the second coupling portion 57.

More specifically, the second coupling portion 57 includes a second facing surface 63. The second facing surfaces 63 of the adjacent final-stage rotor blades 49 face each other. The second facing surfaces 63 facing each other are formed in such a manner as to be in parallel with each other when the detorsion of the blade portions 51 is achieved by the centrifugal force, when the steam turbine 3 is in operation.

For example, the second coupling portion 57 has a triangular pole shape, and has one side surface forming the second facing surface 63.

For example, as illustrated in FIG. 8, in a cross-section of the rotor blade main body 50 at a position where the second coupling portion 57 is provided, an acute angle θa is formed between the second facing surface 63 and a line Lc connecting a front edge and a rear edge of the blade portion 51, and a perpendicular line Lr to the second facing surface 63 crosses the blade portion 51.

A coating layer 65, made of a Co-based alloy having a single composition, is formed on a surface of at least one of the first facing surface 59 and the second facing surface 63 by high-velocity flame spraying. A diffusion layer with a thickness of 10 μm or smaller is provided between the coating layer 65 and the coated layer.

The Co-based alloy is a fretting wear resistant material with high fretting wear resistance. Examples of the Co-based alloy include a Stellite alloy and a Tribaloy alloy. The fretting wear resistant material may be the Co-based alloy or may be a Cu-based alloy such as CuNiIn, CuAl, or CuTi.

In the present embodiment, as schematically illustrated in an enlarged view in a circle in FIGS. 6 and 8, the coating layer 65 is formed on the first facing surface 59 and on the second facing surface 63. In this configuration, in the final-stage rotor blades 49 adjacent to each other, the coating layers 65 on the first facing surfaces 59 facing each other come into contact with each other, and the coating layers 65 on the second facing surfaces 63 facing each other come into contact with each other.

For example, the coating layers 65 are formed entirely on the area where the first facing surfaces 59 facing each other come into contact with each other, and on the area where the second facing surfaces 63 facing each other come into contact with each other.

A method of manufacturing the final-stage rotor blade 49 described above will is described below.

Figure 9:
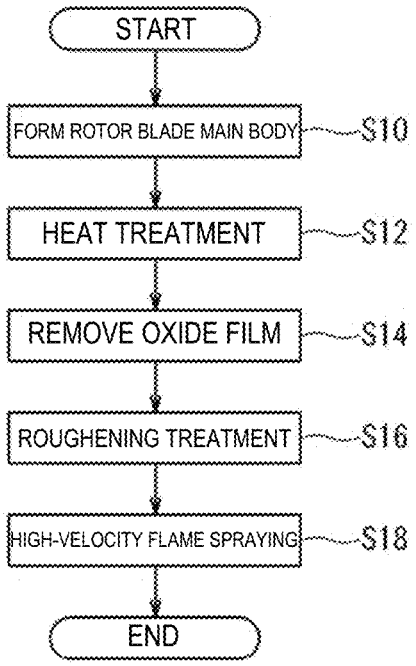
FIG. 9 is a flowchart schematically illustrating a method for manufacturing a final-stage rotor blade.

FIG. 9 is a flowchart schematically illustrating a method of manufacturing the final-stage rotor blade 49. As illustrated in FIG. 9, first of all, the rotor blade main body 50 is formed by forging for example (S10). The rotor blade main body 50 thus formed is subjected to heat treatment to have strength and hardness adjusted (S12). For example, the heat treatment includes a quenching process (solution treatment process) and a tempering process (age hardening treatment process).

For example, the temperature of the solution treatment processing is in a range between 1020° C. inclusive and 1060° C. inclusive, and the temperature of the age hardening treatment process is in a range between 470° C. inclusive and 660° C. inclusive.

For example, surface hardness of the rotor blade main body 50 after the heat treatment is 500HV0.5 or higher according to Vickers hardness test defined by JIS Z2244 2008.

The rotor blade main body 50 after the heat treatment is subjected to oxide film removal processing performed through polishing. Thus, an oxide film on the surface is removed (S14).

The rotor blade main body 50 after the oxide film removal is subjected to roughening treatment executed on the first facing surface 59 and the second facing surface 63 (S16). The roughening treatment in S16 is executed to increase the surface roughness of the first facing surface 59 and the second facing surface 63, and is performed through blasting, for example. In some embodiments, the roughening treatment in S16 is executed through grit blasting using pointed particles.

For example, the first facing surface 59 and the second facing surface 63 after the roughening treatment have an arithmetic average roughness Ra defined by JIS B0601 2013, as the surface roughness, in a range between 6.0 μm inclusive and 7.0 μm inclusive.

When the roughening treatment is executed in S16, an area other than the first facing surface 59 and the second facing surface 63 is masked to be prevented from having a rough surface.

After the roughening treatment on the rotor blade main body 50, the coating layer 65 is formed on the first facing surface 59 and the second facing surface 63 by the high-velocity flame spraying (S18).

HVOF (High Velocity Oxygen Fuel) thermal spraying or HVAF (High Velocity Air Fuel) thermal spraying is performed as the high-velocity flame spraying in S18. In the high-velocity flame spraying in S18, a powder material is sprayed onto a coating target with high-velocity combustion gas generated by combustion of fuel and oxygen or air, so that the coating layer 65 can be formed.

In the present embodiment, the HVOF thermal spraying is employed.

The powder material for forming the coating layer 65 includes a Co-based alloy having the same composition as the coating layer 65.

For example, the powder material has an arithmetic average particle diameter defined by JIS Z8819-2 2001, as the particle diameter, in a range between 10 μm inclusive and 70 μm inclusive.

For example, the powder material is sprayed in a direction inclined, relative to the normal line on the first facing surface 59 or the second facing surface 63 as the coating target, by an angle of incidence θi in a range between 0° inclusive and 60° inclusive, as illustrated in FIG. 8. When the spraying direction is inclined by an angle in the range between 0° inclusive and 60° inclusive, the coating layer 65 can have a low porosity and thus can have a high fretting resistance performance. For example, the porosity of the coating layer 65 is 5% or lower.

In the steam turbine 3 according to at least one embodiment of the present invention described above, the coating layer 65 made of the Co-based alloy having a single composition is formed on at least one of the first facing surface 59 and the second facing surface 63. Adjacent ones of the final-stage rotor blades 49 have the coating layers 65, made of the Co-based alloy having a single composition, in contact with each other. The coating layers 65 made of the Co-based alloy having a single composition have a high fretting resistance performance. Thus, the first coupling portion 55 and the second coupling portion 57 provided with the coating layer 65 are free of damage due to fretting.

The coating layer 65 is formed on the surface of the first facing surface 59 or the second facing surface 63 by the high-velocity flame spraying, with no thermal diffusion processing executed after the high-velocity flame spraying. Thus, the diffusion layer with a thickness of 10 μm or smaller is provided between the coating layer 65 and the surface of the coated layer. Thus, a crack may be formed on the coating layer 65 due to fretting fatigue, but will not reach the first coupling portion 55 or the second coupling portion 57 that has been coated. Thus, the damage due to fretting might occur but does not require replacement of the blade as a whole, and requires simple repairing with Co-based alloy coating provided again through the high-velocity flame spraying. All things considered, a lower repairing cost and a shorter repairing period can be achieved, whereby a higher operation rate of the steam turbine can be achieved.

When the steam turbine 3 is operating, a periphery of the first coupling portion 55 positioned in an outer circumference portion of the final-stage turbine rotor cascade 47 is in a wet region. Still, the first facing surfaces 59 face each other. Thus, the erosion is extremely unlikely to occur on the first facing surfaces 59. The periphery of the second coupling portion 57 positioned at a blade intermediate portion of the final-stage turbine rotor cascade 47 is not in the wet region. Furthermore, the second facing surfaces 63 face each other. Thus, the erosion is extremely unlikely to occur on the second facing surfaces 63 as in the case of the first facing surfaces 59. Thus, no protection film for preventing the erosion is required.

However, it has been found that, due to the recent trend toward a longer final-stage rotor blade and a larger output of the turbine, even the second coupling portion, which is provided to achieve a higher structural damping and of which peak stress acting on its facing surface has been considered to be not so large, has increased peak stress at the contact portion thereof. Thus, the inventors have found that a measure for preventing a damage due to fretting, such as forming a coating layer with high fretting resistance on the facing surface, is preferably implemented.

In some embodiments, the coating layer 65 is directly formed on the first facing surface 59 or the second facing surface 63.

Figure 10:
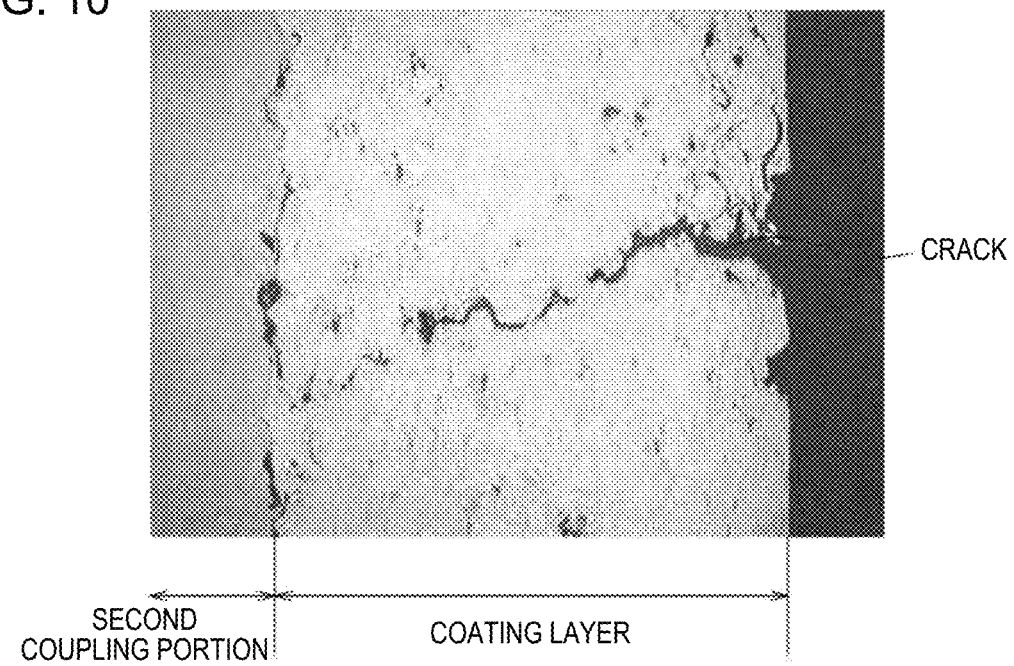
FIG. 10 is a diagram illustrating a result of monitoring a cross-section of a coating layer formed on a second facing surface of a second coupling portion with an optical microscope, after fretting fatigue test.

FIG. 10 illustrates a result of monitoring a cross-section of the coating layer 65 formed on the second facing surface 63 of the second coupling portion 57 with an optical microscope, after fretting fatigue test. As can be seen in FIG. 10, when the coating layer 65 is formed by the high-velocity flame spraying, the thickness of the diffusion layer is 10 μm or smaller, and thus is substantially zero. Furthermore, as can be seen in FIG. 10, the crack (cracking) formed on the coating layer 65 reaches an interface with the coated surface (base material) and then spreads transversely along the interface, and does not reach into the coated layer.

In some embodiments, the Co-based alloy as a material of the coating layer 65 is Stellite (registered trademark) No. 6 having a composition (64Co-28Cr-4W-1C-3Fe) exemplified in Table 1.

TABLE 1

| Element | Concentration (percent by mass) |
|---|---|
| Co | Bal. |
| Cr | 28 |
| W | 4 |
| C | 1 |
| Fe | 3 |

The thickness of the coating layer 65 is in a range between 0.1 mm inclusive and 0.6 mm inclusive in some embodiments, and is in a range between 0.3 mm inclusive and 0.5 mm inclusive in some embodiments.

In some embodiments, the coating layer 65 is at least formed on the second facing surface 63.

In this configuration, the coating layer 65 is formed on the surface of the second facing surface 63 of the second coupling portion 57. Thus, the second coupling portion 57 can be prevented from being damaged due to fretting.

In some embodiments, the final-stage rotor blade 49 may have a blade height of 40 inches or larger.

Figure 11:
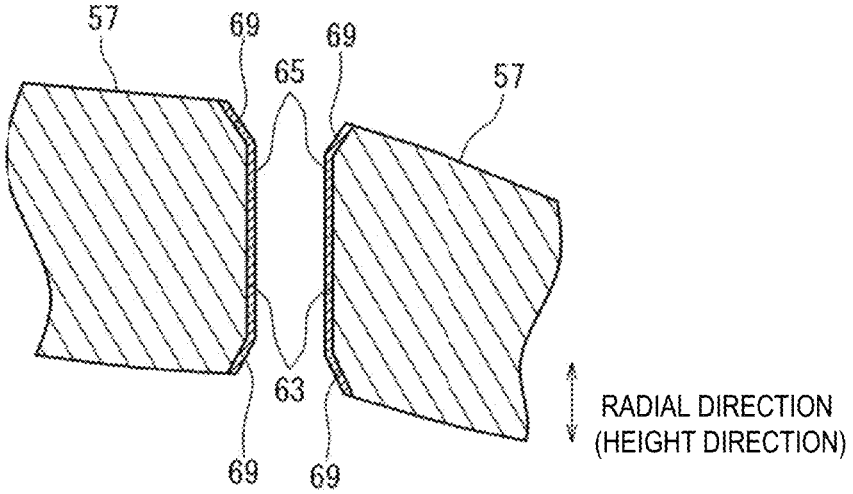
FIG. 11 is a schematic cross-sectional view taken along a line XI-XI in FIG. 8.

FIG. 11 is a schematic cross-sectional view taken along a line XI-XI in FIG. 8. In some embodiments, as illustrated in FIGS. 7 and 11, the second coupling portion 57 includes a second inclined surface 69 configured to achieve a larger distance between adjacent ones of the second coupling portions 57 in the final-stage turbine rotor cascade 47. More specifically, the second inclined surface 69 obliquely continues to each of both side edges of the second facing surface 63.

Both side edges of the second coupling portion 57 are separated from each other in the radial direction of the rotor 43, that is, in a height direction of the final-stage rotor blade 49, and the second inclined surface 69 is inclined with respect to the height direction of the final-stage rotor blade 49.

In this configuration, the second inclined surface 69 that continues to each of both side edges of the second facing surface 63 of the second coupling portion 57 is provided. Thus, uneven contact, that is, local contact between the second facing surfaces 63 is prevented, whereby peak stress acting on the second facing surface 63 can be reduced. All things considered, the second coupling portion 57 can be more effectively prevented from being damaged due to fretting.

When the second inclined surfaces 69 are provided, the area of the second facing surface 63 is substantially reduced, and thus average surface pressure on the second facing surface 63 rises. Still, with the coating layer 65 formed on the surface of the second facing surface 63, fretting wear and fatigue due to the rise in the average surface pressure can be prevented.

In some embodiments, the coating layer 65 is also formed on the second inclined surface 69.

In some embodiments, as illustrated in a schematic enlarged view in the circle in FIG. 5, the first coupling portion 55 includes a first inclined surface 67 configured to achieve a larger distance between adjacent ones of the first coupling portions 55 in the final-stage turbine rotor cascade 47. More specifically, the first inclined surface 67 obliquely continues to each of both side edges of the first facing surface 59.

Both side edges of the first coupling portion 55 are separated from each other in the radial direction of the rotor 43, that is, in the height direction of the final-stage rotor blade 49, and the first inclined surface 67 is inclined with respect to the height direction of the final-stage rotor blade 49.

In this configuration, the first inclined surface 67 that continues to each of both side edges of the first facing surface 59 of the first coupling portion 55 is provided. Thus, uneven contact between the first facing surfaces 59 is prevented, whereby peak stress acting on the first facing surface 59 can be reduced. All things considered, the first coupling portion 55 can be more effectively prevented from being damaged due to fretting.

When the first inclined surfaces 67 are provided, the area of the first facing surface 59 is substantially reduced, and thus average surface pressure on the first facing surface 59 rises. Still, with the coating layer 65 formed on the surface of the first facing surface 59, fretting wear and fatigue due to the rise in the average surface pressure can be prevented.

In some embodiments, the coating layer 65 is also formed on the first inclined surface 67.

In some embodiments, as illustrated in FIGS. 5 and 6, the first coupling portion 55 includes a first curved surface 71 configured to achieve a larger distance between adjacent ones of the first coupling portions 55 in the final-stage turbine rotor cascade 47. The first curved surface 71 continues to distal end edges of the first facing surface 59.

In this configuration, the first curved surface 71 that continues to distal end edges of the first facing surface 59 of the first coupling portion 55 is provided. Thus, uneven contact between the first facing surfaces 59 is prevented, whereby peak stress acting on the first facing surface 59 can be reduced. All things considered, the first coupling portion 55 can be more effectively prevented from being damaged due to fretting wear and fatigue.

When the first curved surfaces 71 are provided, the area of the first facing surface 59 is substantially reduced, and thus average surface pressure on the first facing surface 59 rises. Still, with the coating layer 65 formed on the surface of the first facing surface 59, fretting wear and fatigue due to the rise in the average surface pressure can be prevented.

In some embodiments, the coating layer 65 is also formed on the first curved surfaces 71.

In some embodiments, as illustrated in FIGS. 7 and 8, the second coupling portion 57 includes a second curved surface 73 configured to achieve a larger distance between adjacent ones of the second coupling portions 57 in the final-stage turbine rotor cascade 47. The second curved surface 73 continues to distal end edges of the second facing surface 63.

In this configuration, the second curved surface 73 that continues to distal end edges of the second facing surface 63 of the second coupling portion 57 is provided. Thus, uneven contact between the second facing surfaces 63 is prevented, whereby peak stress acting on the second facing surface 63 can be reduced. All things considered, the second coupling portion 57 can be more effectively prevented from being damaged due to fretting wear and fatigue.

When the second curved surfaces 73 are provided, the area of the second facing surface 63 is substantially reduced, and thus average surface pressure on the second facing surface 63 rises. Still, with the coating layer 65 formed on the surface of the first facing surface 59, fretting wear and fatigue due to the rise in the average surface pressure can be prevented.

In some embodiments, the coating layer 65 is also formed on the second curved surfaces 73.

Figure 12:
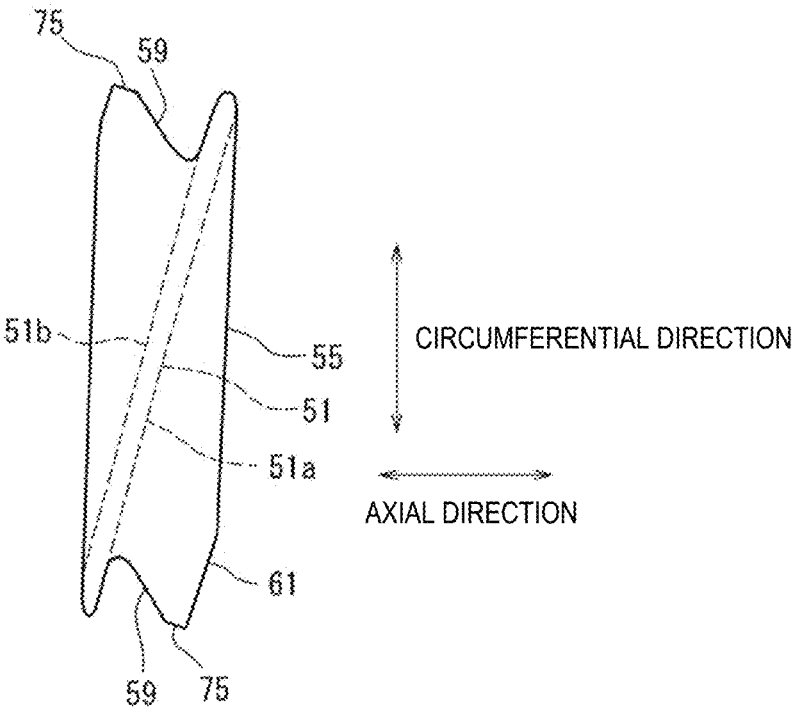
FIG. 12 is a development diagram schematically illustrating one first coupling portion according to another embodiment.
Figure 13:
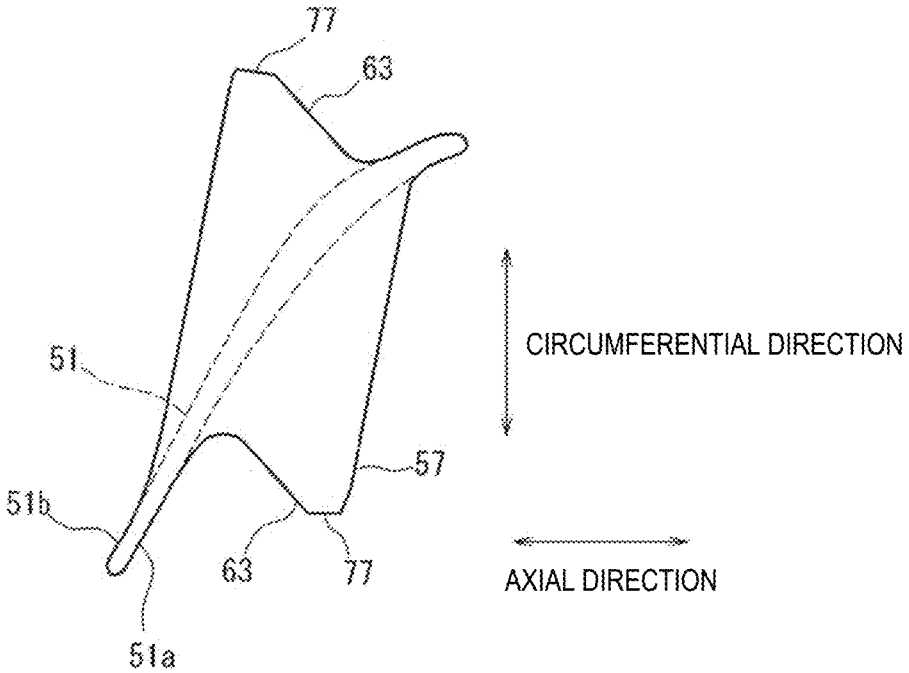
FIG. 13 is a development diagram schematically illustrating one second coupling portion according to the other embodiments.

In some embodiments, as illustrated in FIGS. 12 and 13, the first coupling portion 55 includes a third inclined surface 75 instead of the first curved surface 71, and the second coupling portion 57 includes a fourth inclined surface 77 instead of the second curved surface 73.

The third inclined surface 75 is configured to achieve a larger distance between adjacent ones of the first coupling portions 55 in a turbine rotor cascade. The third inclined surface 75 continues to distal end edges of the first facing surface 59.

The fourth inclined surface 77 is configured to achieve a larger distance between adjacent ones of the second coupling portions 57 in a turbine rotor cascade. The fourth inclined surface 77 continues to distal end edges of the second facing surface 63.

In this configuration, the third inclined surface 75 and the fourth inclined surface 77 are provided so that the first coupling portion 55 and the second coupling portion 57 can be more effectively prevented from being damaged due to fretting, as in the configuration with the first curved surface 71 and the second curved surface 73.

The local stress acting on the distal end edge is larger than that on the side edge in the first facing surface 59 and the second facing surface 63. In view of this, in the configurations illustrated in FIGS. 5 and 7, the first inclined surface 67 or the second inclined surface 69 continues to the side edge, whereas the first curved surface 71 or the second curved surface 73 continues to the distal end edge. With the first curved surface 71 or the second curved surface 73 thus provided in such a manner as to continue to the distal end edge involving higher local stress, the prevention of the uneven contact is guaranteed, whereby the fretting wear and the fretting fatigue can be more effectively prevented.

In some embodiments, the rotor blade main body 50 is made of precipitation hardening stainless steel.

The rotor blade main body 50 made of the precipitation hardening stainless steel is subjected to heat treatment after being formed so that the hardness of the stainless steel is adjusted to be an appropriate value. An example of the heat treatment includes solution treatment and age hardening treatment executed in this order. When the rotor blade main body 50 is heated after the heat treatment, the heat treatment needs to be performed again to adjust the hardness. When any processing is to be executed on the rotor blade main body 50 after the heat treatment, the temperature of the rotor blade main body 50 is required to be managed so as not to exceed the heat treatment temperature.

In this regard, the high-velocity flame spraying, for forming the coating layer 65, involves almost no heating of the rotor blade main body 50. Thus, the high-velocity flame spraying does not change the hardness of the rotor blade main body 50 even when the rotor blade main body 50 is made of the precipitation hardening stainless steel. Thus, the coating layer 65 can be easily formed without requiring any special temperature management for the rotor blade main body 50.

Precipitation hardening stainless steel has a lower frictional coefficient than a titanium alloy. Thus, the rotor blade made of precipitation hardening stainless steel has had almost no risk of fretting wear and fatigue. However, the recent trend toward the larger output of the steam turbine and the longer rotor blades has led to an increase in the peak stress acting on the first facing surface 59 and the second facing surface 63. Thus, it has been found that a risk of the first coupling portion 55 and the second coupling portion 57 being damaged due to fretting has increased.

In view of the above, in some embodiments, the coating layer 65 is provided on at least one of the first facing surface 59 and the second facing surface 63 in the rotor blade main body 50 made of precipitation hardening stainless steel, whereby the damage due to fretting wear and fatigue can be prevented.

In some embodiments, the precipitation hardening stainless steel is 17-4PH (SUS630) having the composition exemplified in Table 2.

When the coated layer is made of the precipitation hardening stainless steel and the coating layer 65 is made of a Co-based alloy, the thickness of the coating layer 65 can be easily measured with an electromagnetic thickness tester. Thus, the separation and wearing of the coating layer 65 can be easily recognized, whereby the coating layer 65 can be quickly repaired if required. The high-velocity flame spraying is performed so that the temperature management is not required for the rotor blade main body 50 and thus the coating layer 65 can be easily repaired.

TABLE 2

| Element | Concentration (percent by mass) |
|---|---|
| C | ≤0.07 |
| Si | ≤1.00 |
| Mn | ≤1.00 |
| P | ≤0.040 |
| S | ≤0.030 |
| Ni | 3.00 to 5.00 |
| Cr | 15.50 to 17.50 |
| Cu | 3.00 to 5.00 |
| Nb + Ta | 0.15 to 0.45 |
| Fe | Bal. |

Figure 14:
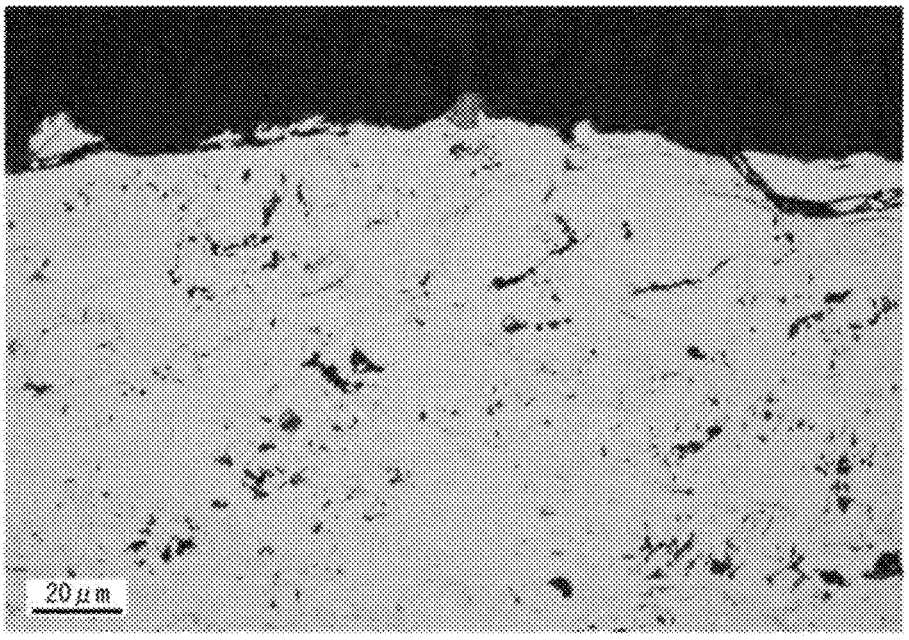
FIG. 14 illustrates a cross-section of a metal structure on a coating layer, according to Example, obtained by high-velocity flame spraying using Stellite (registered trademark) #6.

FIG. 14 illustrates a metal structure on a cross-section of the coating layer, according to Example, obtained by high-velocity flame spraying using Stellite (registered trademark) #6. It can be seen in FIG. 14 that the coating layer according to Example has a substantially uniform metal structure, and does not have an uneven structure. A microhardness test (Hv0.002) performed at a plurality of portions of the coating layer according to Example has indicated that the microhardness is about 800 to 1200 over the entire area of the coating layer. Thus, the metal structure of the coating layer according to Example is substantially uniform.

Figure 15:
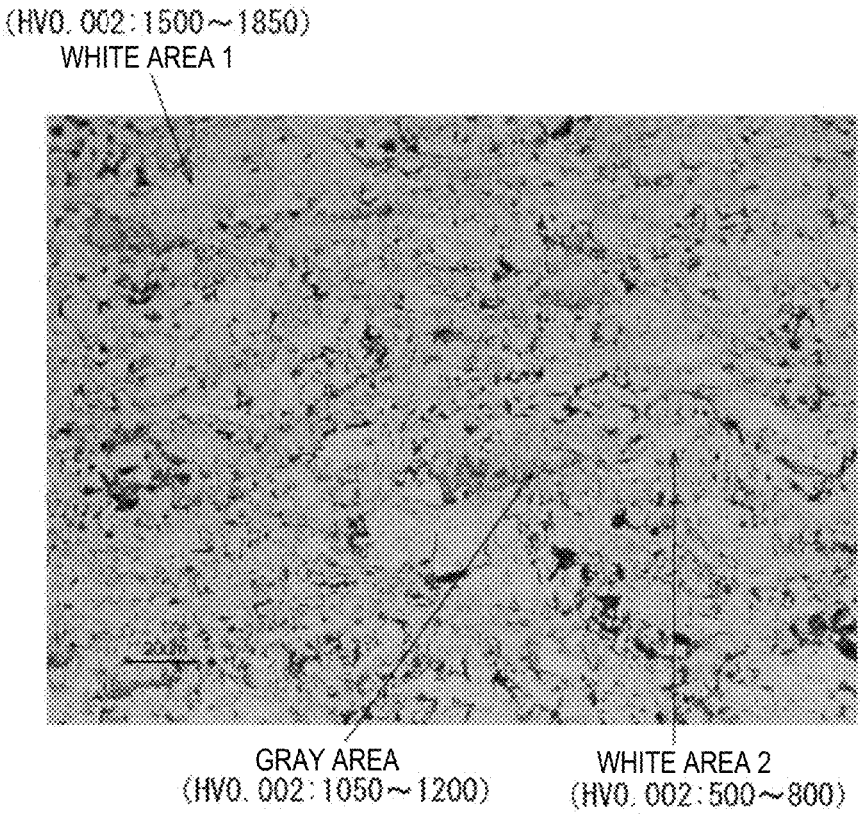
FIG. 15 illustrates a cross-section of a metal structure of a coating layer, according to Comparative Example, obtained by high-velocity flame spraying using mixed powder of Cr3C2 and NiCr (Cr3C2-25NiCr), as well as a result of the microhardness test.

FIG. 15 illustrates a cross-section of a metal structure of a coating layer, according to Comparative Example, obtained by high-velocity flame spraying using mixed powder of Cr3C2 and NiCr (Cr3C2-25NiCr), as well as a result of the microhardness test.

The appearance of the metal structure and the result of the microhardness test illustrated in FIG. 15 indicates that an uneven structure involving a large difference in hardness among areas is formed because the coating layer according to Comparative Example uses the mixture of Cr3C2 and NiCr. More specifically, as illustrated in FIG. 15, the coating layer according to Comparative Example includes a white area 1, a white area 2, and a gray area with a large difference in the microhardness.

A coating layer (spray coating film) obtained by high-velocity flame spraying in which chromium carbide (Cr3C2) is sprayed with NiCr used as a binder may be used for a contact portion with a large area and with a small surface pressure distribution. More specifically, the invention described in Japanese Patent Application Publication No. 2014-163371 features a coating layer obtained by the high-velocity flame spraying in which chromium carbide (Cr3C2) is sprayed with NiCr used as a binder, for achieving higher slidability of a Ti material. It is considered that the invention described in Japanese Patent Application Publication No. 2014-163371 features the high-velocity flame spraying in which CrC is sprayed with NiCr used as a binder, to be suitable for a case where both shroud and stub contact surface in a blade involve "full contact".

However, the present inventors have come up with the following finding for a configuration such as a steam turbine blade involving a local contact. Specifically, the coating layer 65 obtained by the high-velocity flame spraying in which the Co-based alloy having a single composition is sprayed as in the embodiment according to the present invention can achieve a smaller unevenness of the hardness of the structure to achieve higher wear resistance and the like, compared with the coating layer obtained by the high-velocity flame spraying in which a mixture is sprayed. Thus, in the embodiment of the present invention, the coating layer 65 is formed by the high-velocity flame spraying in which the Co-based alloy having a single composition, preferably Stellite (registered trademark) #6, is sprayed. Thus, the coating layer 65 having uniform structure and hardness distribution can be formed to be suitable for local surface contact.

The present invention is not limited to the embodiment described above, and includes a mode obtained by modifying the embodiment, or a mode as a combination of these modes.

The rotor blade used for the final-stage rotor blade 49 can be applied to the steam turbine rotor blade in a stage other than the final-stage, but is especially suitable for the final-stage of the low-pressure steam turbine used under the harshest condition.

This is because the physical property of the coated layer does not change because the coating layer 65 is formed by the high-velocity flame spraying involving a small influence on the coated layer. Thus, for example, stress corrosion cracking can be prevented from occurring in the rotor blade main body 50 under wet steam, even when the coating layer 65 is formed.

REFERENCE SIGNS LIST

1 Gas turbine
3 Steam turbine
5 Exhaust heat recovery boiler
7, 9 Generator
11 Compressor
13 Combustor
15 Turbine
17 Economizer
19 Header
21 Vaporizer
23 Superheater
25 Reheater
27 Denitrifier

29 Chimney
31 High-pressure turbine
33 Mid-pressure turbine
35 Low-pressure turbine
37 Condenser
39 Condensing pump
41 Housing (chamber)
43 Rotor
44, 45 Radial bearing
46 Inner flow path
47 Final-stage turbine rotor cascade
49 Final-stage rotor blade
50 Rotor blade main body
51 Blade portion
51*a* High-pressure surface
51*b* Low-pressure surface
53 Blade base portion
55 First coupling portion
57 Second coupling portion
59 First facing surface
61 Protrusion
63 Second facing surface
65 Coating layer
67 First inclined surface
69 Second inclined surface
71 First curved surface
73 Second curved surface
75 Third inclined surface
77 Fourth inclined surface

The invention claimed is:

1. A steam turbine rotor blade for forming a turbine rotor cascade of a steam turbine, the steam turbine rotor blade comprising:

a rotor blade main body including: a blade portion; a blade base portion on a first end side of the blade portion; a first coupling portion which is on a second end side of the blade portion and has first facing surfaces; and a second coupling portion which is in an intermediate portion of the blade portion and has second facing surfaces, each of the first facing surfaces being configured to face one of first facing surfaces of an adjacent rotor blade main body in the turbine rotor cascade, and each of the second facing surfaces being configured to face one of second facing surfaces of the adjacent rotor blade main body in the turbine rotor cascade; and a coating layer which is made of a Co-based alloy having a single composition and is formed by high-velocity flame spraying on a surface of at least one facing surface of the first facing surfaces and the second facing surfaces, wherein a diffusion layer is formed between the coating layer and the surface of the at least one facing surface of the first facing surfaces and the second facing surfaces by diffusion of an element from the coating layer or the surface of the at least one facing surface of the first facing surfaces and the second facing surfaces, and wherein the diffusion layer has a thickness of 10 μm or less.

2. The steam turbine rotor blade according to claim 1, wherein the at least one facing surface of the first facing surfaces and the second facing surfaces is at least one of the second facing surfaces.

3. The steam turbine rotor blade according to claim 1, wherein the first coupling portion includes first inclined surfaces which obliquely continue to respective side edges of the first facing surfaces whereby the first coupling portion is configured such that a distance between one of the first inclined surfaces of the first coupling portion and a corresponding one of first inclined surfaces of an adjacent first coupling portion in the turbine rotor cascade is greater than a distance between one of the first facing surfaces of the first coupling portion and a corresponding one of the first facing surfaces of the adjacent first coupling portion in the turbine rotor cascade, and wherein the second coupling portion includes second inclined surfaces which obliquely continue to respective side edges of the second facing surfaces whereby the second coupling portion is configured such that a distance between one of the second inclined surfaces of the second coupling portion and a corresponding one of second inclined surfaces of an adjacent second coupling portion in the turbine rotor cascade is greater than a distance between one of the second facing surfaces of the second coupling portion and a corresponding one of the second facing surfaces of the adjacent second coupling portion in the turbine rotor cascade.

4. The steam turbine rotor blade according to claim 1, wherein the first coupling portion includes first inclined surfaces which continue to respective distal end edges of the first facing surfaces whereby the first coupling portion is configured such that a distance between one of the first inclined surfaces of the first coupling portion and a corresponding one of first inclined surfaces of an adjacent first coupling portion in the turbine rotor cascade is greater than a distance between one of the first facing surfaces of the first coupling portion and a corresponding one of the first facing surfaces of the adjacent first coupling portion in the turbine rotor cascade, and wherein the second coupling portion includes second inclined surfaces which continue to respective distal end edges of the second facing surfaces whereby the second coupling portion is configured such that a distance between one of the second inclined surfaces of the second coupling portion and a corresponding one of second inclined surfaces of an adjacent second coupling portion in the turbine rotor cascade is greater than a distance between one of the second facing surfaces of the second coupling portion and a corresponding one of the second facing surfaces of the adjacent second coupling portion in the turbine rotor cascade.

5. The steam turbine rotor blade according to claim 1, wherein the rotor blade main body is made of precipitation hardened stainless steel.

6. A steam turbine comprising a turbine rotor cascade including a plurality of the steam turbine rotor blades according to claim 1.

7. A steam turbine rotor blade for forming a turbine rotor cascade of a steam turbine, the steam turbine rotor blade comprising:

a rotor blade main body including: a blade portion; a blade base portion on a first end side of the blade portion; a first coupling portion which is on a second end side of the blade portion and has first facing surfaces; and a second coupling portion which is in an intermediate portion of the blade portion and has second facing surfaces, each of the first facing surfaces being configured to face one of first facing surfaces of an adjacent rotor blade main body in the turbine rotor cascade, and each of the second facing surfaces being configured to face one of second facing surfaces of the adjacent rotor blade main body in the turbine rotor cascade; and a coating layer which is made of a Co-based alloy having a single composition and is formed by high-velocity flame spraying on a surface of at least one facing surface of the first facing surfaces and the second facing surfaces with a diffusion layer having a thickness of 10 μm or less between the coating layer and the surface, wherein the first coupling portion includes first curved surfaces which continue to respective distal end edges of the first facing surfaces whereby the first coupling portion is configured such that a distance between one of the first curved surfaces of the first coupling portion and a corresponding one of first curved surfaces of an adjacent first coupling portion in the turbine rotor cascade is greater than a distance between one of the first facing surfaces of the first coupling portion and a corresponding one of the first facing surfaces of the adjacent first coupling portion in the turbine rotor cascade, and wherein the second coupling portion includes second curved surfaces which continue to respective distal end edges of the second facing surfaces whereby the second coupling portion is configured such that a distance between one of the second curved surfaces of the second coupling portion and a corresponding one of second curved surfaces of an adjacent second coupling portion in the turbine rotor cascade is greater than a distance between one of the second facing surfaces of the second coupling portion and a corresponding one of the second facing surfaces of the adjacent second coupling portion in the turbine rotor cascade.

8. A steam turbine rotor blade for forming a turbine rotor cascade of a steam turbine, the steam turbine rotor blade comprising:

a rotor blade main body including: a blade portion; a blade base portion on a first end side of the blade portion; a first coupling portion which is on a second end side of the blade portion and has first facing surfaces; and a second coupling portion which is in an intermediate portion of the blade portion and has second facing surfaces, each of the first facing surfaces being configured to face one of first facing surfaces of an adjacent rotor blade main body in the turbine rotor cascade, and each of the second facing surfaces being configured to face one of second facing surfaces of the adjacent rotor blade main body in the turbine rotor cascade; and a coating layer which is made of a Co-based alloy having a single composition and is formed by high-velocity flame spraying on a surface of at least one of the second facing surfaces with a diffusion layer having a thickness of 10 μm or less between the coating layer and the surface of the at least one of the second facing surfaces, wherein the second coupling portion includes:

second inclined surfaces which obliquely continue to respective side edges of the second facing surfaces whereby the second coupling portion is configured such that a distance between one of the second inclined surfaces of the second coupling portion and a corresponding one of second inclined surfaces of an adjacent second coupling portion in the turbine rotor cascade is greater than a distance between one of the second facing surfaces of the second coupling portion and a corresponding one of the second facing surfaces of the adjacent second coupling portion in the turbine rotor cascade; and second curved surfaces which continue to respective distal end edges of the second facing surfaces whereby the second coupling portion is configured such that a distance between one of the second curved surfaces of the second coupling portion and a corresponding one of second curved surfaces of an adjacent second coupling portion in the turbine rotor cascade is greater than a distance between one of the second facing surfaces of the second coupling portion and a corresponding one of the second facing surfaces of the adjacent second coupling portion in the turbine rotor cascade.

9. A steam turbine rotor blade for forming a turbine rotor cascade of a steam turbine, the steam turbine rotor blade comprising:

a rotor blade main body including: a blade portion; a blade base portion on a first end side of the blade portion; a first coupling portion which is on a second end side of the blade portion and has first facing surfaces; and a second coupling portion which is in an intermediate portion of the blade portion and has second facing surfaces, each of the first facing surfaces being configured to face one of first facing surfaces of an adjacent rotor blade main body in the turbine rotor cascade, and each of the second facing surfaces being configured to face one of second facing surfaces of the adjacent rotor blade main body in the turbine rotor cascade; and a coating layer which is made of a fretting wear resistant material and is formed on a surface of each of the second facing surfaces, wherein, in a cross section of the rotor blade main body at a position where the second coupling portion is provided, an acute angle is formed between one of the second facing surfaces and a line connecting a front edge of the blade portion and a rear edge of the blade portion, and a line perpendicular to the one of the second facing surfaces crosses the blade portion, wherein, the second coupling portion includes second inclined surfaces which obliquely continue to respective side edges of the one of the second facing surfaces, the side edges of the one of the second facing surfaces being located on respective ends of the one of the second facing surfaces in a blade height direction of the rotor blade main body whereby a distance between one of the second inclined surfaces of the second coupling portion and a corresponding one of second inclined surfaces of an adjacent second coupling portion in the turbine rotor cascade is greater than a distance between the one of the second facing surfaces of the second coupling portion and a corresponding one of the second facing surfaces of the adjacent second coupling portion in the turbine rotor cascade, and wherein the coating layer extends on the second inclined surfaces of the second coupling portion and the one of the second facing surfaces of the second coupling portion.

10. A method of manufacturing a steam turbine rotor blade for forming a turbine rotor cascade of a steam turbine, the method comprising:

providing a rotor blade main body including: a blade portion; a blade base portion on a first end side of the blade portion; a first coupling portion which is on a second end side of the blade portion and has first facing surfaces; and a second coupling portion which is in an intermediate portion of the blade portion and has second facing surfaces, each of the first facing surfaces being configured to face one of first facing surfaces of an adjacent rotor blade main body in the turbine rotor cascade, and each of the second facing surfaces being configured to face one of second facing surfaces of the adjacent rotor blade main body in the turbine rotor cascade; and performing high-velocity flame spraying to form, on a surface of at least one facing surface of the first facing surfaces and the second facing surfaces, a coating layer which is made of a Co-based alloy having a single composition, wherein, in the performing high-velocity flame spraying, powder of the Co-based alloy is sprayed onto a facing surface to be coated, which is one of the first facing surfaces and the second facing surfaces, at an angle equal to or larger than 0° and equal to or smaller than 60° relative to a normal line of the facing surface such that the coating layer is formed with a diffusion layer formed by diffusion of an element from the coating layer or the facing surface, and wherein the diffusion layer has a thickness of 10 μm or less between the coating layer and the facing surface.

* * * * *